United States Patent [19]

Meyer et al.

[11] Patent Number: 4,859,821

[45] Date of Patent: Aug. 22, 1989

[54] DEVICE FOR DRYING, BY MICRO-WAVES, THE SELVEDGE OF AN ADVANCING FLAT MATERIAL, PARTICULARLY TEXTILE

[75] Inventors: Bertrand Meyer; Alexandre Pijew, both of Lyons, France

[73] Assignee: Institut Textile de France, Boulogne Billancourt Cedex, France

[21] Appl. No.: 192,859

[22] Filed: May 11, 1988

[30] Foreign Application Priority Data

May 11, 1987 [FR] France ..... 87 06574

[51] Int. Cl.[4] ..... F26B 3/28; F26B 3/34

[52] U.S. Cl. ..... 219/10.55 A; 219/10.55 R; 26/106; 34/41

[58] Field of Search ..... 219/10.55 A, 10.55 M, 219/10.55 R; 26/52, 86, 106; 101/470; 34/4, 6, 15, 41, 148, 151, 158

[56] References Cited

U.S. PATENT DOCUMENTS 4,149,322 8/1977 Minoda et al. ..... 34/4

FOREIGN PATENT DOCUMENTS 2448699 9/1980 France .

1211789 11/1970 United Kingdom .

*Primary Examiner*—A. D. Pellinen

*Assistant Examiner*—Leon K. Fuller

*Attorney, Agent, or Firm*—Shenier & O'Connor

[57] ABSTRACT

This invention relates to a device for drying, by micro-waves, the selvedge of an advancing flat material, particularly textile material, wherein it comprises a preferably rectangular waveguide of which one end terminates in a short circuit and the other by a bend for connection to the generator. The outer part of the bend, the contiguous face of the guide and the short circuit are provided with a single slot made along the median plane, through which is introduced the selvedge of the material inside the guide. The face of the guide opposite the slot comprises orifices connected via a chamber to a source of suction. Two lips, parallel to each other and to the median plane extend on either side of an all along the slot; their ends form a slight flare. These lips form a quarter-wave trap and facilitate introduction of the selvedge into the guide.

9 Claims, 3 Drawing Sheets

DEVICE FOR DRYING, BY MICRO-WAVES, THE SELVEDGE OF AN ADVANCING FLAT MATERIAL, PARTICULARLY TEXTILE

FIELD OF THE INVENTION

The present invention relates to the drying, by electromagnetic radiation in the micro-wave range, of a selvedge of a continuously advancing flat material, such as a fabric or cloth. It concerns in particular the pre-drying or post-drying of a heterogeneous selvedge in addition to a conventional drying.

BACKGROUND OF THE INVENTION

Certain textile articles, for example bed sheets, are made from fabrics presenting so-called drawn-in selvedges. Such drawn-in selvedges are obtained during weaving by drawing in, between the warp yarns, the free end of the weft yarn along the selvedge; in this way, the selvedge is clean and the fabric no longer needs to be subsequently cut along the selvedge. However, due to the drawing-in of the weft yarns, the selvedge of the fabric presents an excess thickness and an increase in density of textile material. This local heterogeneity causes differences in behaviour during the treatments undergone by the fabric and in particular during drying of the fabric after impregnation and padding. It has been noted in particular that, at the exit of a drying tenter, there was a considerable difference between the residual humidity rate of the fabric itself and that of the selvedges. Such difference is moreover accentuated when the fabric is transported into the drying tenter by means of a device incorporating clips which grip the fabric along the selvedges on entering the tenter and maintain it to full width until leaving said tenter. The presence of the clips hinders evaporation of the water along the selvedges and does not allow the fabric to dry over a constant transverse humidity profile.

The differences in humidity rate observed between the selvedges and the rest of the flat material, due to the grippers and/or to the drawn-in selvedges, lead the users to overdry the whole of the material in order to obtain an acceptable humidity rate on the selvedges. This practice involves an excess consumption of energy and a limitation of the production rates.

In the domain of drying by a micro-wave radiation, British Pat. No. 1 211 789 discloses a device for drying a glue line along a multi-sheet paper pad. This device comprises an elongated ridged waveguide which is slotted on one of its faces, and guiding means such that the edge of the multi-sheet paper pad containing the glue line can be inserted in the waveguide through the slot and that the glue line is positioned in the region of concentrated energy made by the ridge inside the waveguide.

This known device is not entirely suitable in the case of drying selvedges of a flat, particularly textile, material, since drying is effected locally along a given line defined by the ridge, whilst it is desired to dry the whole surface corresponding to the selvedge.

A device has now been found, and this forms the subject matter of the present invention, whose purpose is specifically to dry a selvedge of a continuously advancing flat material, particularly a textile material, and which is particularly well adapted for pre-drying or post-drying the selvedge of such a material in addition to a conventional drying installation such as a tenter.

SUMMARY OF THE INVENTION

The device of the invention employs, in known manner, a micro-wave radiation coming from a generator and is composed of a guide for propagation of the micro-waves, which is elongated and comprises a single slot allowing passage of the flat material inside the guide. According to the invention, the guide for propagation of the microwaves is not ridged, and it comprises two lips parallel to each other and to the plane of the material, projecting on either side all along the single slot, and forming a cutting guide. The guide is advantageously closed at the end opposite the generator by a slit short circuit.

The wall of the guide opposite the single slot preferably comprises different orifices connected to a suction system.

In this way, the whole selvedge of the flat material is perfectly positioned inside the guide, whilst said material advances continuously; all the lateral part of the material placed in the guide, and consequently the selvedge, is subjected to the action of the micro-waves with a view to being dried; the water vapour emitted during drying of the lateral part of the material, is immediately picked up within the guide itself and evacuated by suction.

The guide for propagation of the micro-waves is preferably a rectangular guide connected by a bent part to the generator and the single slot is made substantially along the median axis of the large lateral face of the guide, contiguous to the outer part of the bend. In this type of waveguide, operating in accordance with $TE_{01}$ mode, it is well known to specialists that the electric field has a general direction which is perpendicular to the two large faces and a component which is maximum in the median plane of the guide; furthermore, on examining the configuration of the lines of current on the walls of the guide, it is observed that none of these lines is intersected by the plane passing through the centre of the two large faces of the guide. Theoretically, there will therefore be no disturbances as to the propagation of the wave. Being given that the single slot is intended to allow passage of that part of the flat material located along the selvedge, it is necessary to provide an opening of sufficient width. However, in order to minimize leakages, the width of the slot must be at the most equal to one third of the length of the large side of the cross section of the waveguide.

Furthermore, the presence of the lips forming a cutting guide limits the risks of leakages of energy.

The orifices made in the wall of the guide opposite the single slot advantageously open into a suction chamber which is itself connected to a single suction source.

In the case of a circular waveguide, operating in accordance with $TM_{01}$ mode, the single slot is made along a generatrix opposite a maximum field zone, and the device is equipped with lugs for blocking the field parallel to the flat material in the guide.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
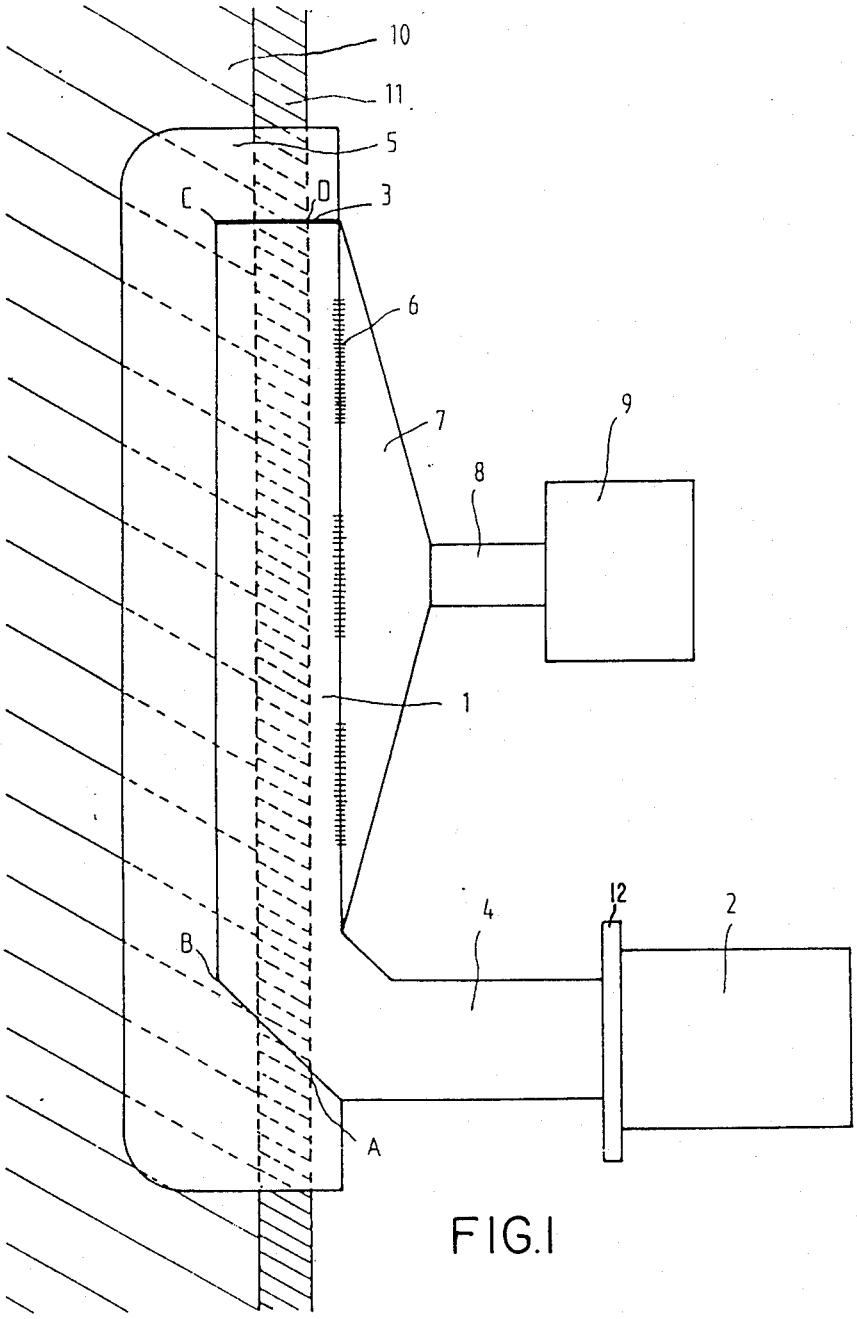
FIG. 1 shows a schematic plan view of the device comprising a rectangular waveguide.
Figure 2:
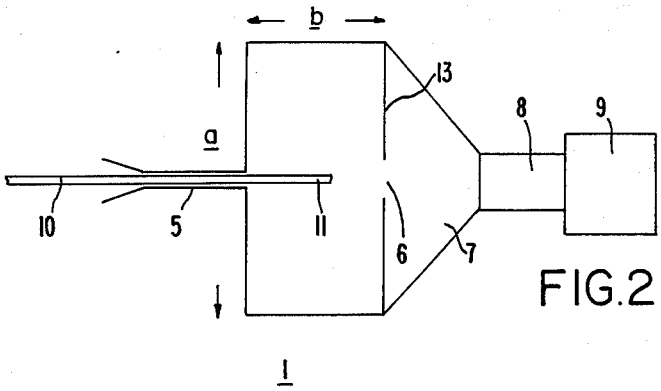
FIG. 2 is a sectional view of the rectangular wave guide.
Figure 3:
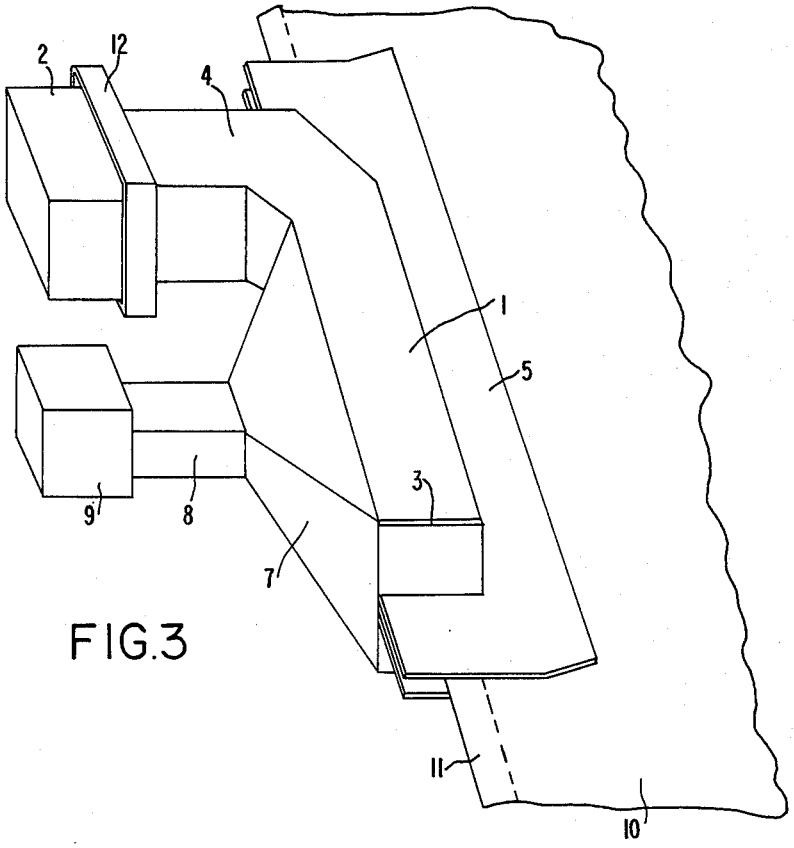
FIG. 3 is a rear elevation of the device comprising a rectangular waveguide.

Referring now to FIG. 3, the waveguide 1 is supplied with micro-waves by generator 2. The cross section of the guide 1 is rectangular with a large side of length and a small side of length b. It operates in accordance with dominant mode $TE_{01}$, and length a is selected as a function of the frequency of the generator so that $a<\lambda<2a$. For a frequency of 2.45 GHz, the dimensions of the sides of the rectangle along a cross section of the guide will be a=9 cm and b=4.5 cm.

The end part of the guide 1 opposite the generator is closed by a short circuit 3. The end part of the guide 1 corresponding to the energy supply terminates in a 90° bend 4 associated with a flange 2 for connection to the supply circuit comprising the generator 2. This supply circuit comprises a guide for propagating the wave on which are mounted the members for adjusting the different operational parameters of the device and in particular an iris; these members are well known to the man skilled in the art and will not be described in greater detail.

The bent part 4, the guide 1 and the short circuit 3 are slit longitudinally over sections AB for the bent part 4, BC all along the guide 1, and CD for the short circuit. This single slot is made along the median axis of the corresponding large face of guide 1. This slot, 0.6 cm wide, allows introduction of the edge of the flat material along its selvedge inside the guide 1 in a zone where the electric field is maximum.

The single slot is provided with two lips 5 parallel to each other and to the median plane, placed immediately on either side of the slot and outside the guide 1. The two lips 5 have a total width of 5 cm; they present on their end part, i.e. over the last 1.5 cm, a flare with respect to the median plane passing through the slot of the order of 15°. This particular form facilitates introduction of the material between the two lips 5. Moreover, these lips form a quarter wave trap avoiding possible parasitic radiations due to the slot.

The presence of the short circuit 3 and of the iris makes it possible to operate in a standing wave regime, the guide 1 operating as a resonant cavity. This is particularly desired in order to limit the total length of the guide, which, in the example described, is 75 cm. Of course, this arrangement requires an impedance matching as a function of the dielectric properties of the flat material to be dried; however, when the quantity of water present in the guide is large, as is the case of a pre-drying on leaving a padding machine, the same adjustment is valid for a wide range of materials.

Opposite the slot and the lips 5, on the rear face of the guide 1, are made five orifices 6 located substantially in the median plane of the slot. These orifices 6 have a substantially rectangular shape of variable length: the two end orifices are 13.5 cm long and the other three orifices are 9 cm long; they are 1 cm wide. They are regularly distributed all along the rear face of the guide 1, and open out on the suction chamber 7. This chamber 7 has the form of and operates like a suction hood; it sucks, via circuit 8 and thanks to the aspirator 9, the water vapour emitted during drying inside the guide 1, through orifices 6.

The device operates as follows: The fabric 10 is a cotton fabric presenting a drawn-in selvedge 11. The generator used has a power of 1200 watts. Fabric 10 passes previously in a padding machine where it is impregnated in a treatment bath then expressed mechanically. The humidity rate of selvedge 11 is of the order of 86%. Before entering the tenter, the fabric 10 is introduced into the device according to the invention described hereinabove, so that the selvedge 11 penetrates in the slot between the lips 5. The fabric 10 is then positioned as illustrated in the Figures. The drawn-in selvedge 11 is located inside the guide 1, in the zone of maximum field.

The device is placed on the path of the fabric between the exit of the padding machine and the entrance proper of the tenter. The guide may be placed in horizontal or vertical position.

At a speed of displacement of 10 meters per minute, the humidity rate of the selvedge 11 after passage in the guide 1 has dropped to about 67%, viz. an evaporation of the order of 20% of water with respect to the weight of the selvedge. At a speed of 20 meters per minute, this evaporation is of the order of 5%, and at 40 per minute, it is of the order of 6%. Such reduction in the humidity rate of the selvedge is sufficient in order, after passage in the tenter, to obtain a fabric regularly dried over the whole of its machine width.

During drying of the fabric in the guide 1, the aspirator 9 is working and all the water vapour produced inside the guide 1 under the action of the micro-waves is sucked through the orifices 6 towards the suction chamber 7 whence it is extracted via conduit 8.

Figure 4:
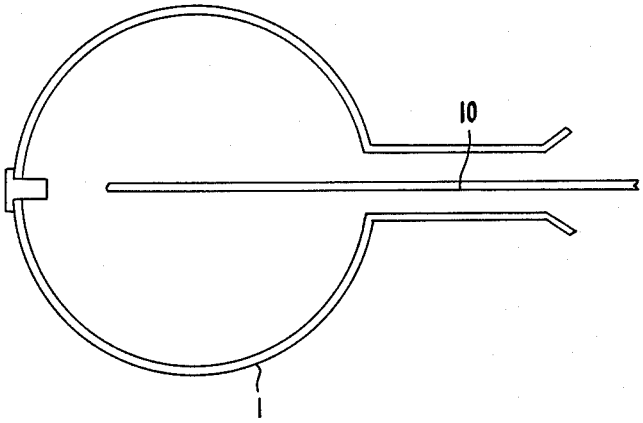
FIG. 4 is a sectional view of the circular waveguide.

The invention is not limited to the embodiment described hereinabove by way of example. In particular, as seen in FIG. 4, the wave guide may be circular in form, in the case of operation according to $TM_{01}$ mode. Furthermore, it is not limited to textile materials, but may be applied to all continuously advancing flat materials presenting a selvedge which must be dried preferentially with respect to the rest of the material. Moreover, it may be applied not only to drying by evaporation of the water, but also to all selvedge treatments for which the action of the micro-waves is positive, for example, fixation of binding agents.

What is claim is:

1. A device for drying a selvedge of a continuously advancing flat material (10), of the type employing micro-wave radiation coming from a generator (2) and composed of an elongated guide (1) for propagation of the micro-waves, provided with a slot, characterized in that the guide (1) comprises two lips (5) which are parallel to each other and to the plane of the material, away from the guide side all along the slot, and forming a quartz-wave trap.

2. A device according to claim 1, characterized in that the guide (1) is closed at the end opposite the generator (2) by a slit short-circuit.

3. Device according to claim 1 characterized in that the wall of the guide (1) opposite the slot comprises different orifices (6) connected to a suction system (7, 9).

4. Device according to claim 2, characterized in that the wall of the guide (1) opposite the slot comprises different orifices (6) connected to a suction system (7,9).

5. Device according to claim 1, characterized in that the guide (1) being a rectangular guide connected by a bend (4) to the generator (2), the slot is made substantially along the median axis of the short circuit (3) and the large lateral face of the guide, contiguous to the outer wall of the bend (4).

6. Device according to claim 2 characterized in that the guide (1) being a rectangular guide connected by a bend (4) to the generator (2), the slot is made substantially along the median axis of the short circuit (3) and the large lateral face of the guide, contiguous to the outer wall of the bend (4).

7. Device according to claim 3, characterized in that the guide (1) being a rectangular guide connected by a bend (4) to the generator (2), the slot is made substantially along the median axis of the short circuit (3) and the large lateral face of the guide, contiguous to the outer wall of the bend (4).

8. Device according to claim 4, characterized in that the guide (1) being a rectangular guide connected by a bend (4) to the generator (2), the slot is made substantially along the median axis of the short circuit (3) and the large lateral face of the guide, contiguous to the outer wall of the bend (4).

9. Device according to claim 1 characterized in that the guide (1) is circular; the slot is made along a generatrix opposite a maximum field zone; and it comprises lugs for blocking the field parallel to the flat material in the guide.

* * * * *

UNITED STATES PATENT AND TRADEMARK OFFICE

CERTIFICATE OF CORRECTION

PATENT NO. : 4,859,821

DATED : August 22, 1989

INVENTOR(S) : Bertrand Meyer and Alexandre Pijew

It is certified that error appears in the above-identified patent and that said Letters Patent is hereby corrected as shown below:

In the Claims:

Claim 1, col. 4, line 52, before "away" insert --projecting";

col. 4, line 53, after "guide" insert --on either--;

col. 4, line 54, change "guartz-wave" to --quarter-wave".

Signed and Sealed this

Twenty-ninth Day of May, 1990

*Attest:*

HARRY F. MANBECK, JR.

*Attesting Officer*

*Commissioner of Patents and Trademarks*